US006250719B1

(12) United States Patent
Gebhardt

(10) Patent No.: US 6,250,719 B1
(45) Date of Patent: Jun. 26, 2001

(54) PAD FOR SEATING SYSTEM

(75) Inventor: Roland Gebhardt, New York, NY (US)

(73) Assignee: Roland Gebhardt Design

( * ) Notice: Subject to any disclaimer, the term of this patent is extended or adjusted under 35 U.S.C. 154(b) by 0 days.

(21) Appl. No.: 09/493,996

(22) Filed: Jan. 27, 2000

(51) Int. Cl.[7] ..... A47C 7/02

(52) U.S. Cl. ..... 297/452.48; 297/452.28; 297/219.1; 5/653; 5/723

(58) Field of Search ..... 297/219.1, 452.48, 297/202, 452.28, 452.47, 452.46; 5/653, 723

(56) References Cited

U.S. PATENT DOCUMENTS 3,081,129 * 3/1963 Ridder ..... 297/452.28 X
3,243,231 * 3/1966 Duffy ..... 297/202
3,679,263 * 7/1972 Cadiou ..... 297/452.48
4,469,372 * 9/1984 Long ..... 297/5

* cited by examiner

*Primary Examiner*—Anthony D. Barfield
(74) *Attorney, Agent, or Firm*—Gottlieb, Rackman & Reisman, P.C.

(57) ABSTRACT

A seating system which includes a seating unit formed with a plurality of openings in the seat and back. Each of these openings is designed for selectively receiving a specially designed seat pad. The inventive seat pad includes a base portion suitable for being disposed over the opening and a stem portion for being disposed through the opening, such that the seat pad unit is fixably retained in the opening.

9 Claims, 2 Drawing Sheets

PAD FOR SEATING SYSTEM

BACKGROUND OF THE INVENTION

This invention relates to a seating system, and more particularly, to one or more seat pads used for a seating system.

Conventional upholstery tends to envelop or partially envelop the seated person. This prevents ventilation, making the person feel hot, particularly when the upholstery is a film-like material (like vinyl), rather than fabric. Hands and exposed skin tend to stick to the surface. These negative effects are magnified during the summer, in the tropics or subtropics.

In the case of exterior seating, conventional upholstery needs to be separate, with cushions being removed when not in use. Rainwater tends to collect, requiring towel-drying or an evaporation period.

Replacing conventional upholstery usually entails replacement of the entire upholstery. This is usually done in workshops, and involves transport and labor costs.

Accordingly, it would be desirable to provide a seating system which overcomes the above disadvantages.

SUMMARY OF THE INVENTION

Generally speaking, in accordance with the invention, the inventive seating system includes a seating unit formed with a plurality of openings in the seat and back. Each of these openings is designed for selectively receiving a specially designed seat pad. The inventive seat pad includes a base portion suitable for being disposed over the opening and a stem portion for being disposed through the opening, such that the seat pad unit is fixedly retained in the opening.

The seat pad is preferably made from a foam or foam-like material, and the pad can be made in various shapes in order to provide different visual appearances.

Accordingly, it is an object of the invention to provide an improved seating system.

Still another object of the invention is to provide a seating system which has improved cushioning along the seat and back portion.

Yet a further object of the invention is to provide an improved seating system which allows for ventilation and drainage along the seat and back portions.

Another object of the invention is to provide a seating system having a plurality of seat pads that can be arranged to form various patterns.

Still a further object of the invention is to provide a seating system having easily replaceable component parts.

Still other objects and advantages of the invention will in part be obvious, and in part be apparent from the following description.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
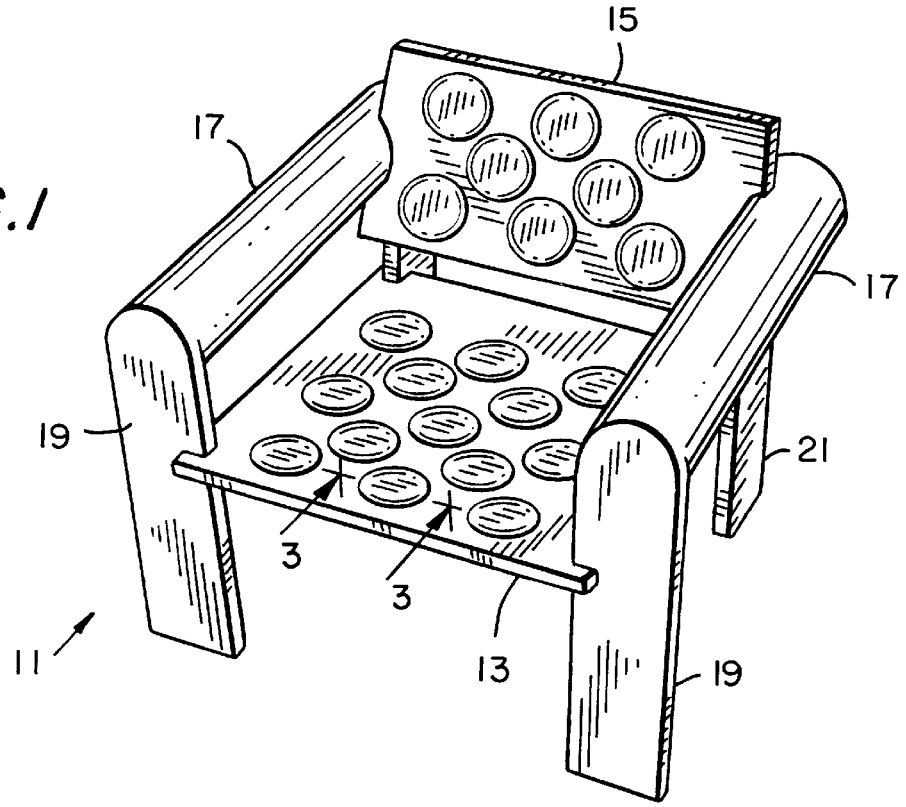
FIG.1 is a perspective view of a lounge chair made in accordance with the invention.

Referring first to FIG. 1, a lounge chair generally indicated at 11 and made in accordance with the invention is shown. Lounge chair 11 includes a seat 13, a back 15, arms 17 extending forward from back 15, front legs 19 extending down from the forward ends of arms 17, and rear legs 21 extending down from back 15. Both front legs 19 and rear legs 21 are formed with cutouts for supportably receiving the corners of seat 13. Seat 13 has a top 14 and a bottom 16.

Figure 3:
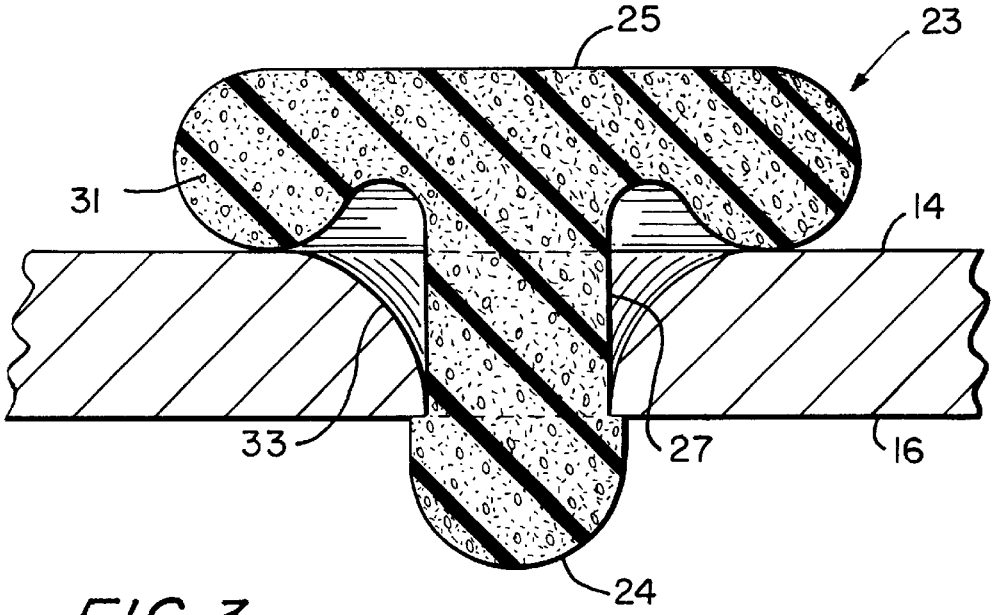
FIG. 3 is a cross-sectional view taken along line 3—3 in FIG. 1.

As best shown in FIG. 3, both seat 13 and back 15 are formed with a plurality of openings 33 designed to selectively receive a seat pad 23 of the invention, as described in more detail below. Although not required, in the embodiment of the drawings, each of openings 33 formed in seat 13 narrows in size (funnel shaped) as it runs from top 14 of seat 13 to bottom 16 of seat 14.

Figure 2:
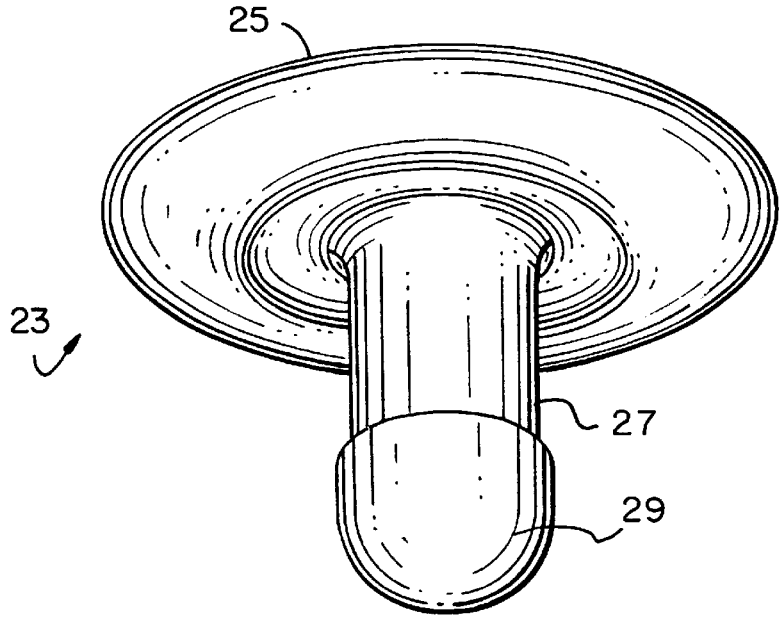
FIG. 2 is a perspective view of the inventive seat pad.

Referring now to FIGS. 2 and 3, seat pad 23 made in accordance with the invention is shown. Seat pad 23 has two major components, an annular or circular base 25 and a stem 27 transversely projecting therefrom. In the embodiment shown, stem 27 has a ball portion 29 formed at its tip for facilitating engagement of stem 27 within opening 33.

Pad 23 is made from a foam or foam-like material, and is therefore somewhat compressible (it can also be made of a hollow continuous skin of flexible material). Base 25 of pad 23 (see FIG. 3) has an annular outer portion 31 which sits or abuts against top 14 of seat 13 when pad 23 is engagingly receiving within opening 33.

Pad 23 is engagingly coupled to opening 33 by first inserting stem 27 through opening 33 until ball portion 29 extends past bottom 16 of seat 13. Importantly, ball portion 29 of pad 23 has a diameter or width slightly larger than the diameter or width of opening 33 at bottom 16 of seat 13. Thus, when stem 27 is inserted through opening 33, ball portion 29 is inwardly compressed a small amount so that it can pass through opening 23, after which its structural size is restored so that it can act as a stop for preventing stem 27 of pad 23 from disengaging from opening 33 of seat 13.

Figure 4:
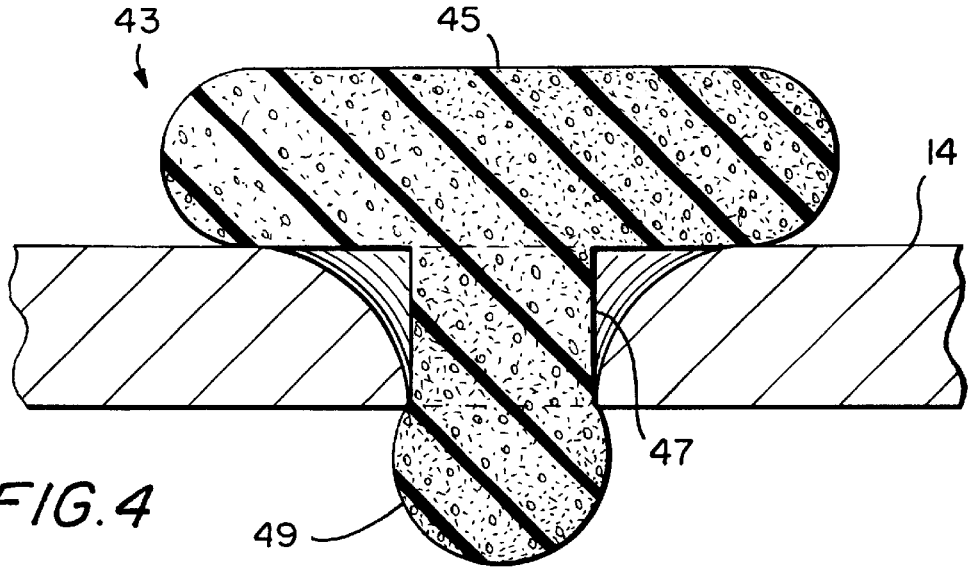
FIG. 4 is a cross-sectional view similar to that of FIG. 3, but illustrating a seat pad of somewhat different design.

Turning now to FIG. 4, an alternative version of the inventive seat pad is shown and generally indicated at 43. As before, pad 43 includes a base portion 45, a stem portion 47 and a ball portion 49. In this embodiment, base portion 43 has a substantially uniform thickness, and therefore, its topside surface is completely seated on top surface 14 of seat 13. In addition, ball portion 29 is slightly different in configuration, resembling more of a pure ball in shape.

The inventive pad, as described above, can function as a cushion for a seat or for a back in any type of seating unit, such as a chair, bench, couch, etc. It can also function as a bumper for mechanical impact, and is suitable for either indoor or outdoor use.

In any seating system, depending on the location of the openings or holes formed in the seat and/or back, numerous arrangements of the pads can be achieved, creating various visual patterns.

Moreover, the shape or design of the inventive product can vary (flat or dome-shaped are two possibilities), thereby facilitating further visual appearances to the inventive system.

Further, the inventive system provides a non-continuous seating surface for enhancing ventilation and drainage.

It will thus be seen that the objects set forth above, among those made apparent from the preceding description, are efficiently attained. Certain changes may be made in the design of the invention without departing from the spirit and scope thereof. It is also understood that the inventive scope is defined by the claims.

What is claimed is:

1. A seating system comprising:

a seating unit having a seat, a seat back, and plurality of legs for supporting said seat, said seat and seat back being formed with a plurality of openings and defining a first seating surface;

a plurality of corresponding removable seat pads made from a compressible material and selectively received by said openings, each of said seat pads together defining a second seating surface and comprising a base portion seated over said corresponding opening and abutting said first seating surface and a stem portion for being disposed through said corresponding opening such that said seat pad is retained therein.

2. The system of claim 1, wherein said seating unit further includes a back formed with a plurality of openings with a corresponding plurality of said seat pads selectively received by said back openings.

3. The system of claim 1, wherein said base portion is annular in shape.

4. The system of claim 1, wherein said stem includes a ball portion at its end.

5. The system of claim 4, wherein said pad is made of a flexible material.

6. The system of claim 4, wherein said pad is made of a foam material.

7. A seating system assembly, said seating system assembly comprising a seating unit having a seat, a seat back and a plurality of legs for supporting said seat, said seat being formed with a plurality of openings and defining a first seating surface, said seating unit having a first configuration in which a plurality of corresponding seat pads are received by said openings so as to define a second seating surface, said seat pads being made from a compressible material and comprising a base portion seated over the corresponding openings and abutting said seating surface, and a stem portion disposed through said corresponding openings; and a second configuration in which said seat pads are no longer received in said openings.

8. A seating system comprising:

a seating unit having a seat, a seat back and a plurality of legs for supporting said seat, said seat and seat back being formed with a plurality of openings;

a plurality of corresponding seat pads for being selectively received by said openings, each of said seat pads comprising a base portion for being seated over said corresponding opening and a stem portion including a ball portion at the end thereof for being disposed through said corresponding opening such that said seat pad is retained therein.

9. A seating system comprising:

a seating unit having a seat and a plurality of legs for supporting said seat, said seat being formed with a plurality of funnel-shaped openings;

a plurality of corresponding seat pads for being selectively received by said openings, each of said seat pads comprising a base portion for being seated over said corresponding opening and a stem portion for being disposed through said corresponding opening such that said seat pad is fixedly retained therein.

* * * * *